US005782114A

United States Patent [19]

Zeus et al.

[11] Patent Number: 5,782,114

[45] Date of Patent: Jul. 21, 1998

[54] MULTI-POINT LOCKING SYSTEM

[75] Inventors: Christian Zeus, Stilfs; Josef Mairvongrasspeinten, Pfalzen, both of Italy

[73] Assignee: Hoppe AG, St. Martin I.P., Italy

[21] Appl. No.: 563,657

[22] Filed: Nov. 28, 1995

[30] Foreign Application Priority Data

Jan. 13, 1995 [DE] Germany ..... 295 00 502 U

[51] Int. Cl.[6] ..... E05B 63/20

[52] U.S. Cl. ..... 70/109; 70/110; 292/34; 292/150

[58] Field of Search ..... 70/109, 107, 108, 70/110, 111; 292/9, 23, 193, 34, 35, 147, 150

[56] References Cited

U.S. PATENT DOCUMENTS

| | | | |
|---|---|---|---|
| 513,279 | 1/1894 | Ridgway | 292/DIG. 51 X |
| 927,231 | 7/1909 | Giese | 292/193 X |
| 1,596,992 | 8/1926 | Ognowicz | 70/109 |
| 1,646,674 | 10/1927 | Augelillo | 70/109 |
| 2,943,877 | 7/1960 | Pleterski | 292/23 |
| 3,953,061 | 4/1976 | Hansen et al. | 292/34 X |
| 4,227,723 | 10/1980 | Rosell | 292/34 |
| 4,446,707 | 5/1984 | Mullich et al. | 70/134 |
| 5,118,145 | 6/1992 | Tucker | 292/23 X |
| 5,265,920 | 11/1993 | Kaup et al. | 70/107 X |
| 5,373,716 | 12/1994 | MacNeil et al. | 70/109 |

FOREIGN PATENT DOCUMENTS

| | | | |
|---|---|---|---|
| B-0 385 213 | 11/1992 | European Pat. Off. . | |
| 2540170 | 8/1984 | France | 70/109 |
| A-4 110 556 | 10/1992 | Germany . | |
| 2122244 | 1/1984 | United Kingdom | 70/109 |
| 2225052 | 5/1990 | United Kingdom | 70/109 |

*Primary Examiner*—Lloyd A. Gall
*Attorney, Agent, or Firm*—Lowe, Price, LeBlanc & Becker

[57] ABSTRACT

A multi-point locking system (10) has a lock case (11) with a door front edge (20), a latch (65), a blocking bolt (80) and two longitudinally movable push rods (30, 31) connected to one another by a connecting element (40) with locking elements such as eccentrically mounted roller pins (33) engaging in striking plates (34). The connecting element (40) has an engagement recess (46), is arrestable by a spring-loaded engaging element (52) against a compression spring (48) in a pretensioned opening position, and is releasable from this arrested position by direct operation of the locking elements (33) in the longitudinal direction of the door front edge. The striking plates (34) in the entry area (36) of the locking elements (33) have inclined stop surfaces (37) exerting a force (F) on the roller pins (33) in the closing direction (Y). The slidingly guided bolt (80) blocks the locking system (10) indirectly via a flexibly mounted rocker (91) using a closing element (81), for example a locking cylinder.

43 Claims, 5 Drawing Sheets

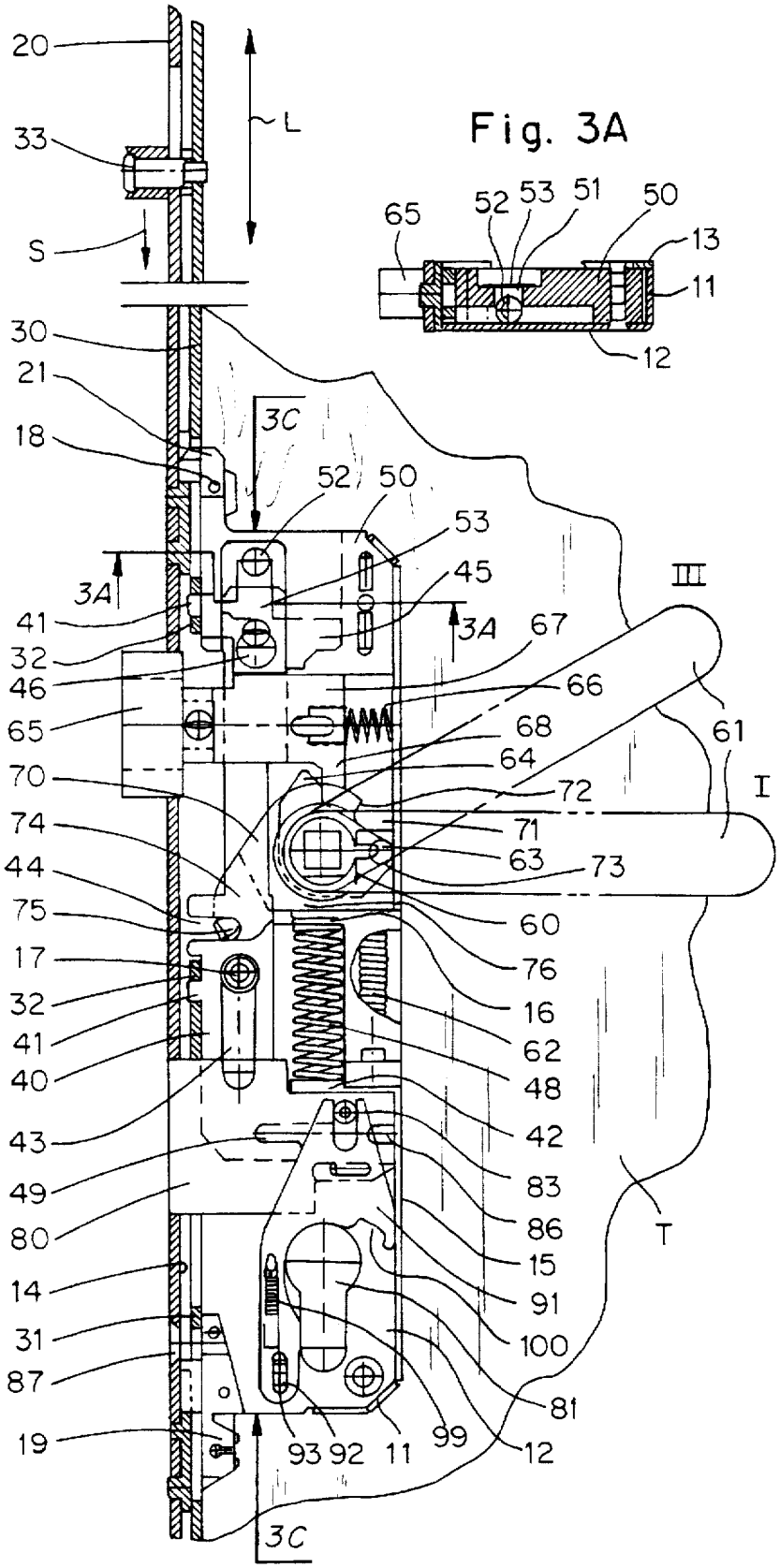
Fig. 1A
Fig. 3A
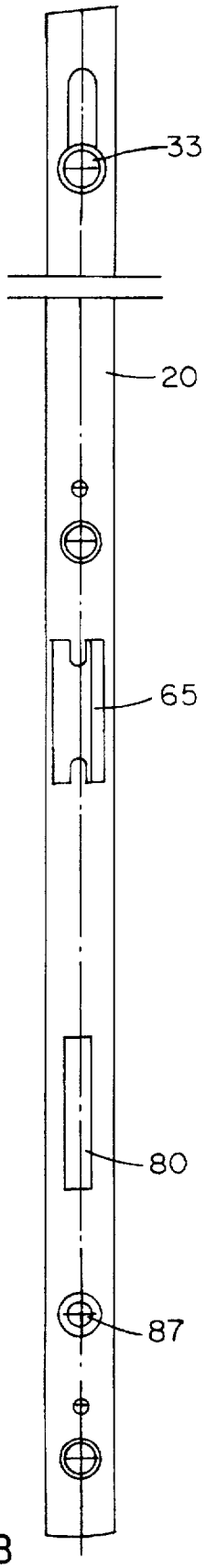
Fig. 1B

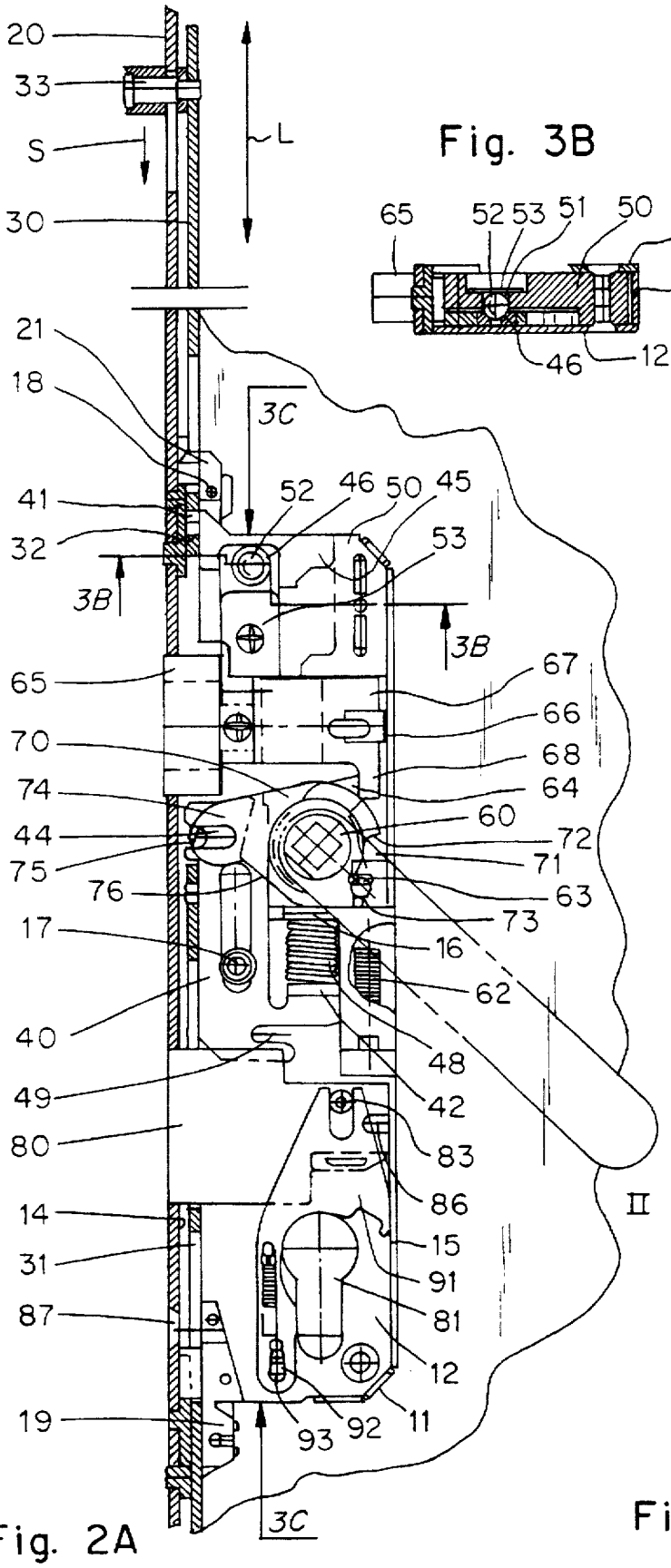
Fig. 2A
Fig. 3B
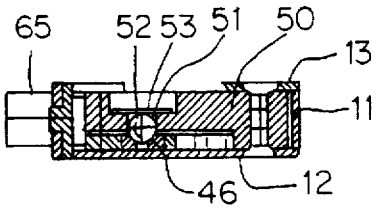
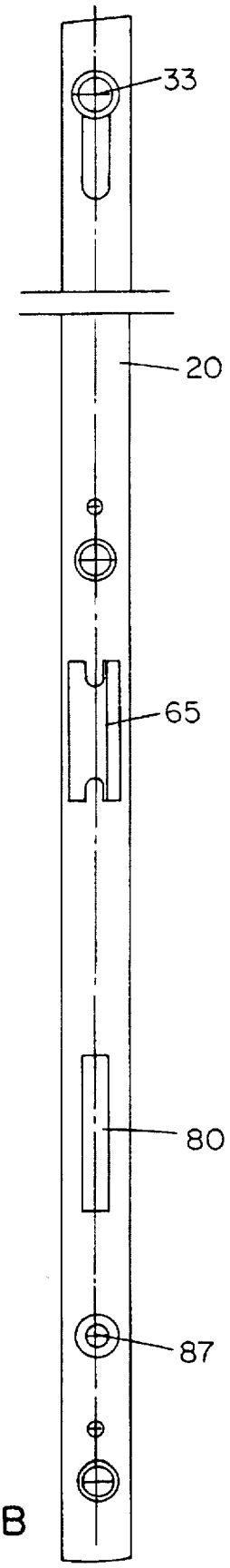
Fig. 2B

MULTI-POINT LOCKING SYSTEM

FIELD OF THE INVENTION

The invention relates to a multi-point locking system.

DESCRIPTION OF THE PRIOR ART

External and internal house doors usually close with a latch and bolt near the middle of the door. For various reasons, it is of interest to lock the door front at further points to the door case outside the lock case, for example to increase burglar deterrence or to prevent warping of the closed door. The door locks used to do so usually have two or more locking elements such as roller pins, mushroom-head pins, tongues etc. arranged equidistantly along the front edge and driven/operated by longitudinally movable push rods on sliding guides behind the front edge. The locking elements engage in corresponding recesses set into the door case at appropriate points. These so-called driving rod locks are operated by turning a key to be inserted into the locking cylinder or by operating a pivotally mounted handle (lever) against a spring force.

To ensure that the locking elements automatically engage in their matching lock parts when the door is closed, without the need for a force to be exerted on the handle, the locking elements are pretensioned against a spring force when the door is opened using the push rods and arrested in an opening position. When the door contacts the door frame, the push rods are triggered by a triggering device and the locking elements are returned automatically to their closing positions by the spring action and engage there. The active spring force is dimensioned to ensure dependable closing of the doors.

A closing device of this type is described in EP-B1-0 385 213, for example. Driving rods guided behind front rail sections are moved into matching lock parts on the frame side by turning a handle or by releasing an energy accumulator acting on the driving rods, with the release of the energy accumulator being achieved using a release operated by the frame when the door is closed. The release, a swivel lever provided with a feeler element, and the energy accumulator designed as a compression spring are arranged on the rear of the freely projecting front rail sections, to which end these sections and the driving rods have oppositely shaped curvatures. The swivel lever is held in a centre position by a tension spring and rests in a throat of an abutment fastened on the driving rod. To release the lever-controlled lock, the pin-type feeler element passes through a curved slot concentric to the swivel lever pivoting point and, when the door is closed, moves through an entry opening in a striking plate on the door frame side. The swivel lever is swivelled out of its centre position and releases the spring-loaded driving rods. In addition to the closing elements on the driving rods, additional feeler elements with a relatively complicated lever construction are necessary to register the closing of the door. In addition, special recesses must be provided in the door frame so that outward bulges of the door front edge do not project and catch against the door frame. The design and manufacture require a great deal of effort and the door locks are correspondingly expensive.

Another closing device in accordance with DE-A1-4 110 556 has, in a lock casing, an energy accumulator chargeable by the opening action of a lock and releasable by the contact of a feeler against the door frame. This solution too involves an expensive lever and gear construction which is also complicated to use. Pretensioning of the driving rods is only possible by the back-closing movement of a locking cylinder, while the arresting action must be released by synchronous operation of the feeler and the handle-operated latch.

SUMMARY OF THE INVENTION

The object of the invention is to provide a multi-point locking system that is simple in design and easy to use. Furthermore, the space requirement for lock case and front edge rails must be minimized.

The main features of the invention are set forth in the the claims.

In a multi-point locking system for locking doors having a lock case, a door front edge attached thereto, a spring-loaded latch passing through said door front edge, a blocking bolt passing through the door front edge and operable via a closing element, and at least two longitudinally movable push rods connected to one another by a connecting element with locking elements engaging in corresponding recesses, where the push rods are movable into an opening position against a resetting force by a handle pivotally mounted in a nut and arrestable in this pretensioned position, the invention provides that the push rods are releasable from the arrested position by direct operation of the locking elements in the longitudinal direction of the door front edge. Special release lever mechanisms to be provided on the door front edge or integrated into the lock case are not necessary to effect the engagement of the locking elements mounted on the driving rods in their recesses in the door frame; instead the design in accordance with the invention permits a surprisingly simple and sturdy construction for a multi-point locking system that is convenient to use.

In accordance with another feature of the invention, a force acting parallel to the push rods can be exerted on the locking elements by closing the door. This releases the driving rods in the closing direction from their arrested position without the need for an additional lever/handle operation.

The recesses are, as provided for in another aspect of the invention, formed by striking plates let into the door frame, which according to yet another aspect of the invention have stop surfaces disposed in the entry area of the locking elements and inclined at an angle to the push rod longitudinal direction. When the locking elements make contact, a force component acting parallel to the push rods is advantageously exerted on the locking elements that causes an automatic triggering of the arresting action. To ensure that the locking elements pull the door positively against the door frame, the striking plates may have at least one lateral surface disposed offset at an angle to the push rod longitudinal direction.

In conformity with another feature of the invention, at least one locking element is a roller pin functioning as a release and which can, in accordance with yet another feature of the invention, be eccentrically mounted. This makes it possible by simple adjustment of the roller pins to optimise the contact of the closed doors.

To effectively prevent any warping of the closed door, the length of the door front edge extends, in accordance with another feature of the invention, preferably over the full door height, with another feature of the invention providing for at least one roller pin on each push rod. The roller pins serve advantageously to release the arresting action, this being optionally possible with a single roller pin or jointly and synchronously with all roller pins.

In an embodiment of still another feature of the invention, the connecting element between the push rods is loaded by a compression spring, for example a helical spring, in the closing direction. This permits precise dosing of the resetting force and ensures high operational dependability.

The nut operated by a handle, knob or the like has in accordance with another aspect of the invention a driver nose for operating the latch and a driver pin preferably disposed with a circumferential offset of 90°. This pin engages in a circumferential recess with stop edges of a nut sleeve that encloses the nut in the embodiment in accordance with still another feature of the invention. Furthermore, still another feature of the invention provides for the nut sleeve to have a claw that engages with a recess in the connecting element. A rotary movement exerted on the nut by the handle is transmitted simply via the nut sleeve and the connecting element to the push rod. If the handle is operated downwards, the latch and the locking elements are lifted simultaneously from their engaged settings and the latter are arrested in an opening position. The door can be opened. If the handle is turned upwards, the arresting action is also released using the nut sleeve. The locking elements can be manually engaged in their striking plates. This is particularly necessary if the doors have warped.

To limit the upward handle movement, another feature of the invention provides for the nut sleeve to have a stop surface for contact with a lock case projection.

A significant further development of the invention is found in that the connecting element has an engagement recess, for example a ball socket, into which a spring-loaded engaging element positively engages in the opening position of the push rods: By this engagement of the ball, the push rods are held in a surprising simple way in an opening position without a blocking lever arrangement being necessary. In accordance with another feature of the invention, the engagement recess can also be elongated in form and the engaging element can be a ball or a cylindrical section of, for example, 5 mm in length.

Also of importance is the design of the multi-point locking system in accordance with the invention. This provides that the closing bolt is operable using a closing element, e.g. a locking cylinder, indirectly via a lever arrangement. Conventional rack-like bolt recesses or complex gear units effecting only a slight bolt exclusion per key revolution are avoided. Instead, the easily achieved lever arrangement, which in accordance with another aspect of the invention has a rocker flexibly mounted in a pivotal point, a considerably greater bolt exclusion. The rocker has on its end facing away from the pivotal point a slot which in accordance with another feature of the invention encloses a guide nose of the bolt. The latter is, in accordance with another aspect of the invention, slidably guided in the guide slot. To drive the rocker with the bit of the locking cylinder the rocker may have recess facing the locking cylinder.

To prevent any unauthorised opening of a door locked with the multi-point locking system in accordance with the invention, the bolt has in accordance with another feature of the invention a claw that engages with a recess in the connecting element in the closing position of the bolt. A movement of the connecting element and hence of the push rods is thereby prevented by simple means. Since the handle is also connected to the connecting element via the nut sleeve, this nut sleeve too cannot be forced downwards.

BRIEF DESCRIPTION OF THE DRAWING

Further features, details and advantages of the invention can be found in the wording of the claims and in the following description of a design example on the basis of the drawing. The drawing shows in FIG. 1*a* a side view of a multi-point locking system in accordance with the invention, partially in cross-section, in the closed position, with removed lock case cover, FIG. 1*b* a front view of the multi-point locking system in FIG. 1*a*, FIG. 2*a* a side view of the multi-point locking system, partially in crosssection, in the opened position, with removed lock case cover, FIG. 2*b* a front view of the multi-point locking system in FIG. 2*a*, FIG. 3*a* a sectional view along the line 3A—3A in FIG. 1*a*, FIG. 3*b* a sectional view along the line 3B—3B in FIG. 2*a*, FIG. 3*c* a partial sectional view of the multi-point locking system in semi-opened/closed position along the line 3C—3C in FIGS. 1*a* and 2*a*, FIGS. 4*a*, *b*, *c* a plan view of a striking plate with a diagrammatically indicated locking element in various closing positions, FIG. 5*a* a side view of a closing bolt in the opened position and FIG. 5*b* a side view of the bolt of FIG. 5*a* in the closed positions,

DESCRIPTION OF THE PREFERRED EMBODIMENTS

Figure 3C:
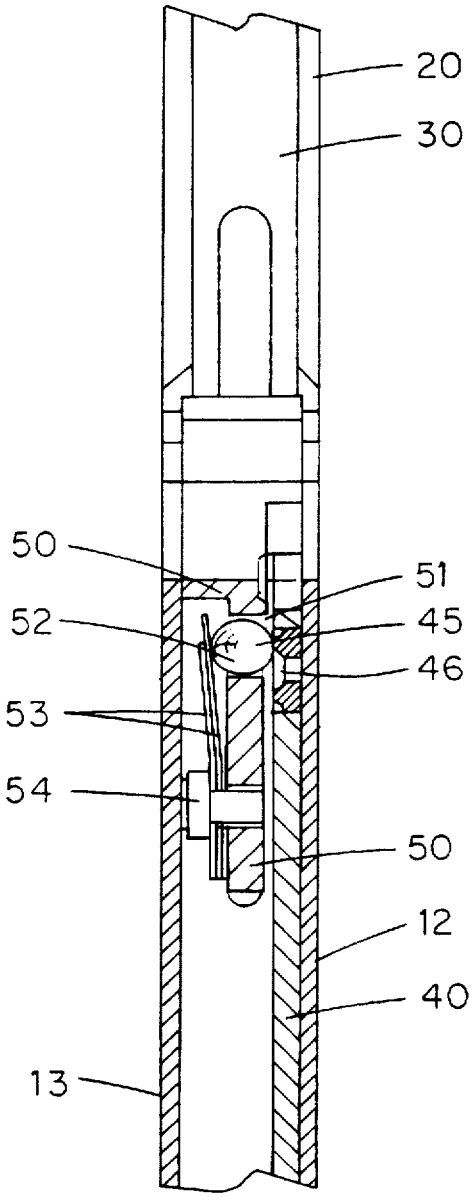

The multi-point locking system 10 shown in FIGS. 1*a*, 1*b*, and 2*a*, 2*b*, has a lock case 11 with a bottom part 12 and a cover 13 (not shown), a door front edge 20 attached to the lock case front 14 and preferably extending over the full door height of a door T, and an upper push rod 30 and a lower push rod 31, each mounted longitudinally movable using roller pins 33 passing through the door front edge 20. These pins engage in the closed position in striking plate recesses 35 and thereby lock a door leaf T positively with a door case or door frame R.

A connecting element 40 sliding on the bottom part 12 of the lock case 11 in the form of a push rod shoe connects the movement of the push rods 30, 31 in that the latter, for example by the recesses 32, positively grip corresponding noses 41 on the shoe 40. The shoe is loaded by a compression spring 48 acting in the longitudinal direction L of the push rod and resting on a lock case projection 16 and on a shoulder 42 on the shoe 40. In order to prevent the latter from straying during its sliding movement, a longitudinal slot 43 is guided on a (stationary) pin 17. At its top end 45 the push rod shoe 40 has an engagement recess 46, preferably in the form of a ball socket. It grips with this end 45 underneath a guide block 50 having a hole 51 all the way through and vertical to the bottom part 12. The hole is covered by a leaf spring 53 and contains an engaging element 52, such as a ball freely movable in the hole direction, the height of the hole 51 being dimensioned such that the ball 52 resting on the bottom part 12 recedes into the hole 51, but does not project beyond it.

Between the bottom part 12 and the cover 13 of the lock case 11, a lock nut 60 is mounted in rotatably movable fashion. This is used to hold a handle 61 indicated only by a dashed line in FIGS. 1*a* and 2*a* and held by a resetting spring 62 in a centre position designated with I. The nut 60 has a driver pin 63 and a driver nose 64 preferably disposed with an angular offset of 90° for operating a latch 65 that is slidably guided above the lock nut 60 between the bottom part 12 and the cover 13. It is loaded in the outward direction by a compression spring 66 resting on the lock case rear wall 15 and has on its rear end 67 a tongue 68 pointing downwards.

Around lock nut 60, there is pivotally mounted a nut sleeve 70 including a peripheral recess 71 opposite which an arm 74 has a dog 75 that reaches into a recess 44 of the push rod shoe 40. Peripheral recess 71 comprises upper and lower stop edges 72 and 73, respectively, whereas a (plane) stop face 76 limits the rotation of nut sleeve 70 by engaging the lock case projection 16.

FIG. 1*a* shows the multi-point locking system 10 in the closed position. The compression spring 48 forces the push rod shoe 40 and hence the push rods 30, 31 with the roller pins 33 downwards, with the shoe 40 resting on a stop, for example on a pin 17, in the end position of the roller pins 33, and the latter engage completely in their striking plates (cf. FIG. 4*c*). The driver pin 63 of the lock nut 60 is in contact with the lower stop edge 73 of the circumferential recess 71 of the nut sleeve 70, which can rest with its stop surface 76 on the lock case projection 16. The bail 52 seated in the guide block 50 rests on the lock case bottom part 12 (see FIG. 3*a*).

If the handle 61 is pressed downardly against the forces of the resetting spring 62 and the compression spring 48 into the position indicated with II (see FIG. 2*a*), the latch 65 is retracted against the force of spring 66) as dog 64 of the lock nut 60 engages tongue 68, pin 63 of the lock nut 60 now leaving upon peripheral recess 71 serves to rotate nut sleeve 70 and thus its arm 74. As a result, the push rod shoe 40 and the connected push rods 30, 31 and roller pins 33 are moved in the opening direction. The upper part 45 of the shoe 40 engaging underneath the guide block 50 lifts the ball 52 in the hole 51 against the force of the leaf spring 53. As soon as the latch 65 contacts with its back the rear wall 15 of the lock case, the ball socket 46 stops concentrically underneath the hole 51 and the ball 52 is pressed by the leaf spring 53 firmly into the ball socket 46 (see FIG. 3*b*). The force of the compression spring 48 is now no longer sufficient to move the shoe into its lower closing position. Instead, the push rods 30, 31 and the roller pins 33 remain arrested in the opening position. If the handle 61 is released, it is returned by its return spring 62 into its initial position I, with the driver pin 63 of the lock nut 60 however contacting the upper stop edge 72 of the circumferential recess 71.

To return the locking elements 33 to their closing position, the engaging force of the leaf spring 53 acting on the ball 52 must be overcome. This can be simply achieved in two ways, with the level of the engaging force depending on the thickness of the leaf spring 53. This can easily be set for example by simply layering several leaf springs 53 one above the other. The individual leaf springs 53 are for that purpose attached to the block 50 using a screw 54 as shown in FIG. 3*c*.

By turning the handle 61 into the position III indicated in FIG. 1*a*, the nut sleeve 60 and hence the extension 74 is turned to the left by the driver pin 63 in contact with the upper stop edge 72. As a result a force is transmitted to the push rod shoe 40 that is sufficient to release the ball engagement. The compression spring 48 forces the push rod shoe 40 and the push rods 30, 31 mounted thereon downwards into the end position preset by the stop 17 and/or the stop surface 76. The roller pins 33 engage in the striking plates 34 and lock the door T with the door frame R.

Figure 4C:
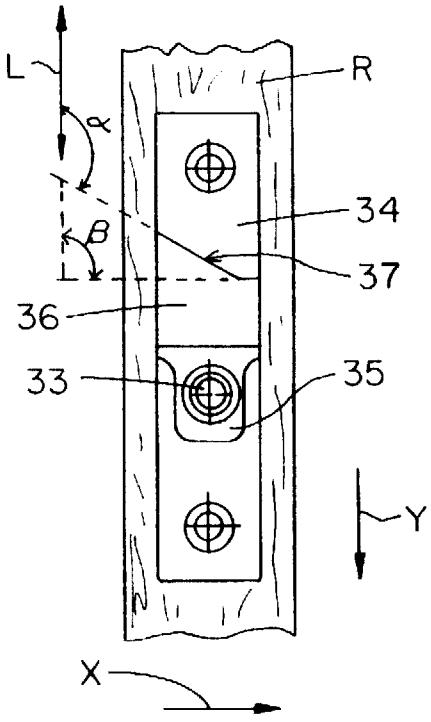
Figure 4B:
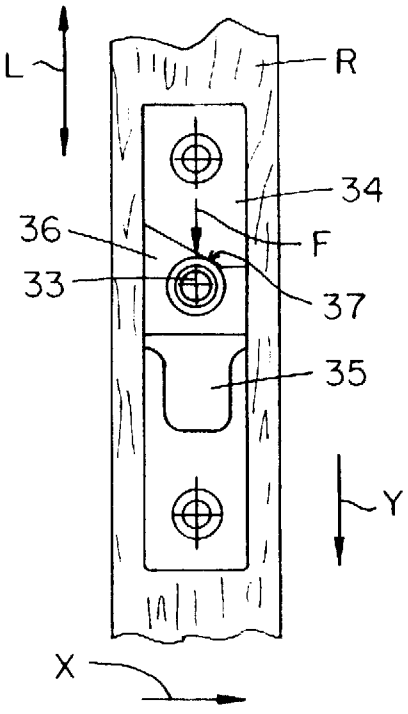
Figure 4A:
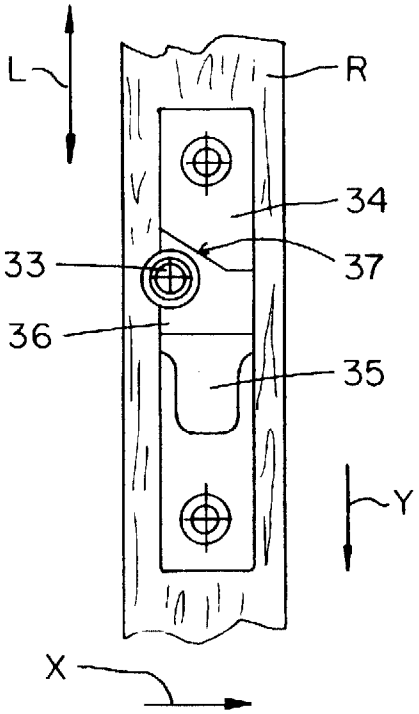

An automatic locking of the multi-point locking system 10 is achieved when the roller pins 33 engaging in the striking plates 34 come up against the inclined stop surface 37 when closing the door in the closing direction X. This surface can be, as shown in FIGS. 4*a* to 4*c*, an inclined surface 37 disposed above the entry opening 36 of the striking plates 34 and, for example, at an angle of $\alpha 35°$ in relation to the push rod longitudinal direction L which is at an angle $\beta$ to a lateral surface 38 joining the inclined surface 37 (FIG. 4*c*). In this way the normal force acting on the roller pins 33 exerts a force F in the closing direction Y on the pins 33 that is sufficient to release the ball engagement. The compression spring 48 pushes the push rod shoe 40 and the roller pins 33 connected to it downwards as already described and thereby locks the door T (FIG. 2*a*, FIG. 4*c*). If the latter has warped, for example due to unfavourable climatic conditions, with the result that the roller pins 33 cannot engage fully in the striking plates 34 and/or the force of the compression spring 48 is insufficient to move the push rod shoe 40 into its end position, the locking action can be achieved by simply turning the handle 61 upwards into the position III shown in FIG. 1*a*.

Figure 5A:
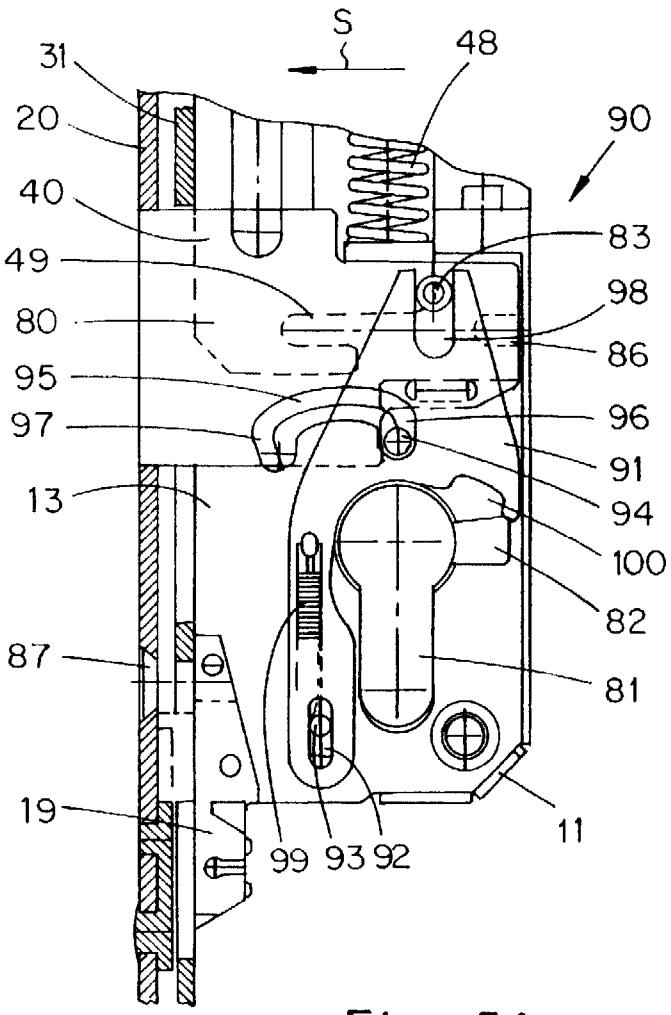
Figure 5B:
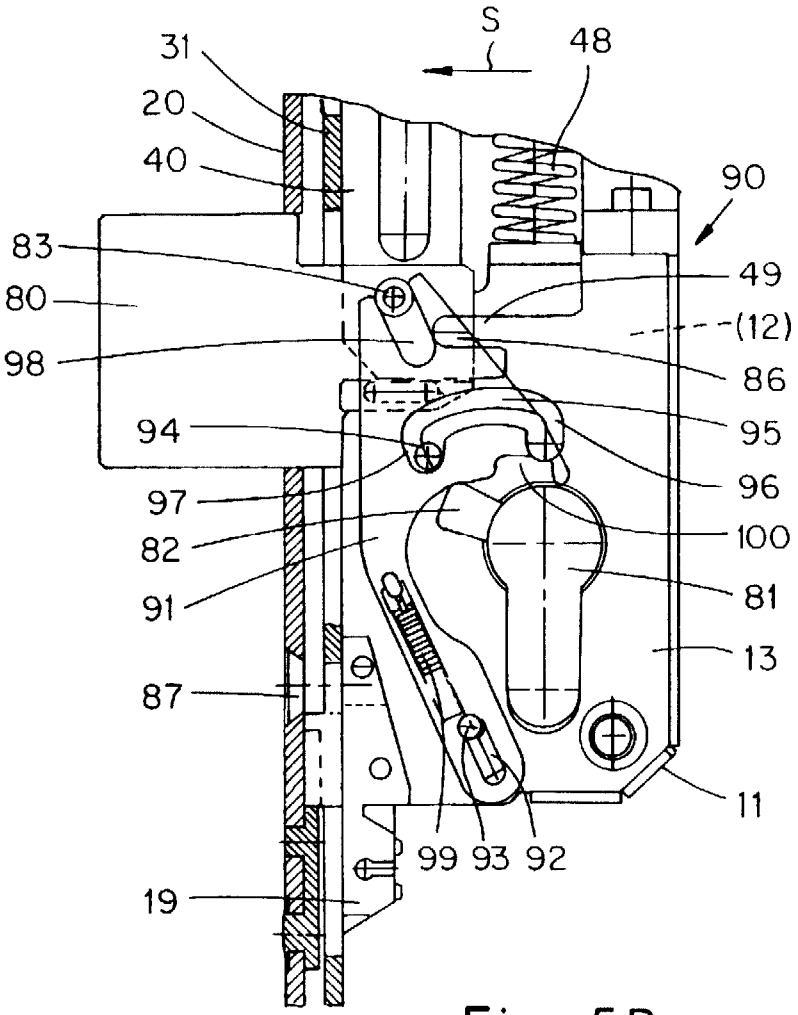

In order to secure the locked state in a door T locked with a multi-point locking system 10 against unauthorized persons, a closing bolt 80 is slidably mounted between the bottom plate 12 and the cover 13 of the lock case 11 (FIGS. 5*a*, 5*b*). This bolt passes through the lower push rod 31 and is preferably operated indirectly via a rocker 91 by a locking cylinder 81. The rocker 91 is mounted pivotably with a longitudinal slot 92 on a bearing pin 93 and guided with a transverse bolt 94 in a U-shaped cutout 95 in the lock cover 13, with the end of the rocker 91 facing away from the bearing 93 having a recess 98 enclosing a guide cam 83 of the bolt 80.

In the opened position, shown in FIG. 5*a*, the rocker 91 rests with its transverse bolt positively on the end of the rear part 96 of the U-shaped hole 95 and is pulled downwards by a tension spring 99. If the locking cylinder 81 is turned with the aid of a key (not shown) in the closing direction S, the key bit 82 engages from underneath in a recess 100 and lifts the rocker 91 against the force of the spring 99. The transverse bolt 94 is here lifted out of the rear part 96 of the "U" and the rocker 91 is swivelled while with the bolt 80 is moved in its exclusion direction S. When the end position of the bolt 80 is reached, the key bit 82 leaves the recess 100 and the rocker 91 is pulled downwards again by the spring 99. The transverse bolt 94 engages in the front, downward-pointing part 97 of the hole 95 and thereby prevents in a simple way an inadmissible sliding-back of the bolt 80 in the opening direction. If however the locking cylinder 81 is turned in the opening direction, the key bit 82 lifts the flexibly mounted rocker 91 again so that the bolt 80 is retracted by the guide cam 83. By a suitable selection of the pivot point 93 of the rocker 91, a lever ratio is obtained that provides a considerably greater bolt exclusion compared to conventional drive types and with the same key turning angle.

If a claw 86 is arranged on the rear of the bolt and engages in a recess 49 of the push rod shoe 40 in the closing position S of the bolt 80, the entire opening mechanism is blocked, since all the components needed for opening the lock are connected to one another.

For transportation and storage of the multi-point locking system 10, it can be of advantage when the door front edge 20 is detachably connected to the lock case 11. To that end, the door front edge 20 has a fitting hook 21 that hooks in behind a transverse pin 18 preferably arranged on the guide block 50. Then the door front edge 20 a rid the lock case 11 are swivelled about the transverse pin 18 and non-positively connected to one another in a catch 19 provided at the lower end of the lock case 11. This connection is quick and convenient to achieve and does not become loose even during long transport. The door front edge 20 is only firmly connected to the lock case 11 using a screw 87 when the multi-point locking system 10 is actually fitted to the door T. Here the screw 87 of the locking cylinder 81 is advantageously used.

The invention is not restricted to one of the above embodiments, but is variable in many ways. For example, the engagement recess 46 can be cylindrical in cross-section and the engaging element 52 can be a correspondingly shaped cylinder. If required, the automatic engagement of the roller pins 33 can be easily dispensed with when the door T is closed by removing the compression springs 48. When opening the door, the push rod shoe 40 is arrested in its opening position by the engaging elements 46, 52, 53, but the release of the shoe 40 and the engagement of the locking elements 33 in the striking plates 34 must be performed manually by turning the handle 61 upwards into the position III, thereby achieving a high operational dependability. The force applied to press down the handle 61 is however rather small (having dispensed with springs 48), which can be of advantage when the multi-point locking system 10 is used in children's' or old people's homes.

It is clear that a multi-point locking system 10 has a lock case 11, a door front edge 20 for attachment thereto, a latch 65, a locking bolt 80 and two longitudinally movable push rods 30, 31 connected to one another by a connecting element 40 with locking elements 33 engaging in striking plates 34, for example eccentrically mounted roller pins. The connecting element 40 provided with a engagement recess 46 is in accordance with the invention arrestable in a pretensioned opening position by means of a spring-loaded engaging element 52 against the force of a compression spring 48 and releasable from this position by direct operation of the locking elements 33 in the longitudinal direction L of the door front edge 20. The striking plates 34 preferably have for that purpose inclined stop surfaces 37 disposed in the entry area 36 of the locking elements 33 and exerting on the roller pins 33 a force F in the closing direction Y. For locking the multi-point locking system 10 the sliding bolt 80 is operable by a closing element 81, for example a locking cylinder, indirectly by means of a flexibly mounted rocker 91. The multi-point locking system 10 is extremely simple and sturdy in design. The few components, usually combining several functions, can be accommodated without difficulty in a lock case 11 of quite small dimensions, permitting installation of the multi-point locking system 10 even in tubular frame doors.

All features and advantages, including design details, spatial arrangements and procedural steps, that are shown in the claims, the description and the drawing, can be substantial to the invention both per se and in their various combinations.

We claim:

1. A multi-point locking system (10) for locking doors (T) having a lock case (11), a door front edge (20) attached thereto, a spring-loaded latch (65) passing through said door front edge (20), a locking bolt (80) passing through said door front edge (20) and operable via a closing element (81) and at least two longitudinally movable push rods (30, 31) connected to one another by a connecting element (40) with locking elements (33) engaging in corresponding recesses, where the push rods are movable into an opening position against a resetting force by a handle mounted in a pivotable nut and are arrestable in this pretensioned position, wherein the connecting element (40) between the push rods (30, 31) is loaded in a closing direction (Y) by a compression spring (48) and wherein the push rods (30, 31) are releasable from the arrested position by direct operation of the locking elements (33) in the longitudinal direction (L) of the door front edge (20).

2. A locking system according to claim 1 wherein a force (F) acting parallel to the push rods (30, 31) can be exerted on the locking elements (33) by closing the door (T).

3. A locking system according to claim 1, wherein the recesses (35) are formed by striking plates (34) let into a door frame (R).

4. A locking system according to claim 3, wherein the striking plates (34) have stop surfaces (37) disposed in an entry area (36) of the locking elements (33) and inclined at an angle ($\alpha$) to the push rod longitudinal direction (L).

5. A locking system according to claim 3, wherein the striking plates (34) have at least one lateral surface (38) disposed offset at an angle ($\beta$) to the push rod longitudinal direction (L).

6. A locking system according to claims 1, wherein at least one locking element (33) is a roller pin.

7. A locking system according to claim 6, comprising a plurality of roller pins and wherein the roller pins (33) are eccentrically mounted.

8. A locking system according to claim 6, wherein at least one roller pin (33) is attached to each push rod (30, 31).

9. A locking system according to claim 1, wherein the nut (60) has a driver nose (64) for operating the latch (65) and a driver pin (63), said driver pin disposed with circumferential offset of 90°.

10. A locking system according to claim 1, wherein the nut (60) is enclosed by a pivotally mounted nut sleeve (70) that has a circumferential recess (71) with stop edges (72, 73).

11. A locking system according to claim 1, wherein the nut (60) is enclosed by a nut sleeve (70) having a claw (75) that engages with a recess (44) in the connecting element (40).

12. A locking system according to claim 1, wherein the nut (60) is enclosed by a nut sleeve (70) having a stop surface (76) for contact with a lock case projection (16).

13. A multi-point locking system according to claim 1, wherein the connecting element (40) has an engagement recess (46) into which a spring-loaded engaging element (52) positively engages in the opening position of the push rods (30, 31).

14. A locking system according to claim 13, wherein the engagement recess (46) is elongated in form and the engaging element (52) comprises a ball or a cylindrical section.

15. A locking system according to claim 1, wherein the locking bolt (80) is operable using a closing element (81) indirectly via a lever arrangement (90).

16. A locking system according to claim 15, wherein the lever arrangement (90) has a rocker (91) flexibly mounted in a pivotal point (93), which rocker has on its end facing away from the pivotal point (93) a slot (98).

17. A locking system according to claim 16, wherein the rocker (91) with its slot (98) entrains a guide cam (83) of the bolt (80).

18. A locking system according to claim 15, wherein the bolt (80) is slidably guided.

19. A locking system according to claim 16, wherein the rocker (91) has a guide cam (94) slidably guided in an arc-shaped cutout (95).

20. A locking system according to claim 16, wherein the rocker (91) has a recess 100 facing the closing element.

21. A locking system according to claim 15, wherein the bolt (80) has a claw (86) that engages with a recess (49) in the connecting element (40) in a closing position of the bolt (80).

22. A multi-point locking system (10) for locking doors (T) including a lock case (11), a door front edge (20) attached thereto, a spring-loaded latch (65) passing through the door front edge (20), a locking bolt (80) that passes through the door front edge (20) and is operable via a closing unit (81), at least two longitudinally movable push rods (30, 31) joined to one another by a connection element (40) and provided with locking elements (33) that engage in corresponding recesses (35) of striking plates (34) fixed to a door frame (R) opposite the door front edge (20), and further including a handle (61) mounted to turn with a pivotable lock nut (60) whereby the push rods (30, 31) are movable into an opening position against a resetting force and are arrestable in a pretensioned position, wherein the connection element (40) between the push rods (30, 31) is loaded by a compression spring (48) in a closing direction (Y) and wherein the push rods (30, 31) are releasable from an arrested position by direct operation of the locking elements (33) in a longitudinal direction (L) of the door front edge (20).

23. A locking system according to claim 22, wherein the compression spring (48) is a helical spring.

24. A locking system according to claim 25, wherein the striking plates (34) have stop surfaces (37) disposed in an entry area (36) of the locking elements (33) and inclined at an angle ($\alpha$) to the longitudinal direction (L) whereby a force (F) acting parallel to the push rods (30, 31) is exerted on the locking elements (33) as the door (T) is closed.

25. A locking system according to claim 24, wherein the striking plates (34) have at least one lateral surface disposed offset at an angle ($\beta$) to the longitudinal direction (L).

26. A locking system according to claim 25, wherein at least one locking element (33) is a roller pin.

27. A locking system according to claim 26, wherein at least one roller pin (33) is attached to each push rod (30, 31).

28. A locking system according to claim 27, wherein the locking elements, in particular roller pins (33), are eccentrically mounted.

29. A locking system according to claim 22, wherein the nut (60) has driver nose (64) for operating the latch (65) and a driver pin (63) disposed with a circumferential offset.

30. A locking system according to claim 29, wherein the circumferential offset amounts to 90°.

31. A locking system according to claim 29, wherein the nut (60) is enclosed by a pivotally mounted nut sleeve (70) that has a circumferential recess (71) with stop edges (72, 73).

32. A locking system according to claim 31, wherein the nut sleeve (70) has a dog (75) that engages with a recess (44) in the connection element (40).

33. A locking system according to claim 31, wherein the nut sleeve (70) has a stop surface (76) for contact with a lock case projection (16).

34. A locking system according to claim 22, wherein the connection element (40) has an engagement recess (46) into which a spring-loaded engaging element (52) positively engages in the opening position of the push rods (30, 31).

35. A locking system according to claim 34, wherein the engagement recess (46) is a ball socket.

36. A locking system according to claim 35, wherein the engagement recess (46) is elongated in form and the engaging element (52) is a ball or a cylindrical section.

37. A locking system according to claim 22, wherein the locking bolt (80) is indirectly operable via a lever arrangement (90) acted on by the closing unit (81).

38. A locking system according to claim 37, wherein the closing unit (81) is a locking cylinder.

39. A locking system according to claim 37 wherein the lever arrangement (90) includes a rocker (91) having a slot (92) flexibly mounted on a pivotal point (93), which rocker has on its end facing away from the pivotal point (93) a recess (98) which guides a guide cam (83) of the bolt (80).

40. A locking system according to claim 37 wherein the locking bolt (80) is slidably guided.

41. A locking system according to claim 39 wherein the rocker (91) includes a guide cam (94) slidably guided in an arc-shaped cutout (95).

42. A locking system according to claim 38 wherein the rocker (91) has a recess (100) facing the locking cylinder (81) for engagement by a key bit (82) of the locking cylinder (81).

43. A locking system according to claim 37 wherein the locking bolt (80) has a dog (86) engaging a recess (49) in the connection element (40) in a closing position of the locking bolt (80).

* * * * *

UNITED STATES PATENT AND TRADEMARK OFFICE

CERTIFICATE OF CORRECTION

PATENT NO. : 5,782,114

DATED : July 21, 1998

INVENTOR(S) : Christian Zeus, Josef Mairvongrasspeinten

It is certified that error appears in the above-identified patent and that said Letters Patent is hereby corrected as shown below:

Col. 5, line 20, delete "bail" and insert --ball--;

line 23, delete "downardly" and insert --downwardly--;

line 26, before "against" insert --(--;

line 28, delete "leaving" and insert --bearing--.

Col. 6, line 65, delete "a rid" and insert --and--.

Signed and Sealed this

Twenty-ninth Day of February, 2000

*Attest:*

Q. TODD DICKINSON

*Attesting Officer*

*Commissioner of Patents and Trademarks*